US010760826B2

(12) United States Patent
Ning et al.

(10) Patent No.: US 10,760,826 B2
(45) Date of Patent: Sep. 1, 2020

(54) DOUBLE ACTING ALPHA STIRLING REFRIGERATOR

(71) Applicant: Liping Ning, Pingdu (CN)

(72) Inventors: Liping Ning, Pingdu (CN); Weijie Ning, Pingdu (CN)

(73) Assignee: Liping Ning, Pingdu (CN)

( * ) Notice: Subject to any disclaimer, the term of this patent is extended or adjusted under 35 U.S.C. 154(b) by 0 days.

(21) Appl. No.: 16/346,122

(22) PCT Filed: Apr. 18, 2018

(86) PCT No.: PCT/CN2018/083455
§ 371 (c)(1),
(2) Date: Apr. 30, 2019

(87) PCT Pub. No.: WO2018/210089
PCT Pub. Date: Nov. 22, 2018

(65) Prior Publication Data

US 2020/0064030 A1 Feb. 27, 2020

(30) Foreign Application Priority Data

May 17, 2017 (CN) ..... 2017 1 0347418

(51) Int. Cl.
*F25B 9/14* (2006.01)
*F04B 7/04* (2006.01)
*F04B 39/00* (2006.01)

(52) U.S. Cl.
CPC ..... *F25B 9/14* (2013.01); *F04B 7/04* (2013.01); *F04B 39/0016* (2013.01); *F25B 2500/221* (2013.01)

(58) Field of Classification Search
CPC ..... F04B 25/005; F04B 35/04; F04B 39/005; F04B 39/0016; F04B 53/12; F04B 53/123; F02G 1/043; F02G 1/0435
See application file for complete search history.

(56) References Cited

U.S. PATENT DOCUMENTS 1,240,862 A * 9/1917 Lundgaard ..... F02G 1/043 62/6
1,382,334 A * 6/1921 Williams ..... F04B 37/12 417/552

(Continued)

FOREIGN PATENT DOCUMENTS

CN 1043555 A 7/1990
CN 1723347 A 1/2006

(Continued)

*Primary Examiner* — Jianying C Atkisson
*Assistant Examiner* — Miguel A Diaz
(74) *Attorney, Agent, or Firm* — Bayramoglu Law Offices LLC

(57) ABSTRACT

A double acting alpha Stirling refrigerator includes a piston cylinder and a piston, the piston is provided in the piston cylinder. The piston is in a clearance fit with an inner wall of the piston cylinder. A closed cavity is formed inside the piston. A cross-shaped four-way pipe is provided in the cavity of the piston. A one-way air outlet valve and a one-way air inlet valve are further respectively provided on the four-way pipe in the cavity of the piston. An air outlet for connecting the cavity of the piston to the inner cavity of the piston cylinder is provided on the piston. A traction frame movable relative to the piston cylinder is provided outside the piston cylinder, and the movement of the piston is controlled by the movement of the traction frame.

13 Claims, 7 Drawing Sheets

(56) References Cited

U.S. PATENT DOCUMENTS 2,015,126 A * 9/1935 Replogle ..... F04B 39/0016 417/553
2,150,487 A * 3/1939 Brown ..... F04B 39/0016 92/80
2,464,560 A * 3/1949 Davey ..... F04B 39/0016 417/203
2,506,751 A * 5/1950 Trask ..... F04B 39/0016 417/550
4,132,510 A * 1/1979 Takahashi ..... B26D 7/086 417/534
4,350,082 A * 9/1982 Carrens ..... F16J 9/00 277/336
4,387,568 A * 6/1983 Dineen ..... F02G 1/0435 60/517
4,388,809 A * 6/1983 Sarcia ..... F25B 9/14 137/624.13
4,409,793 A * 10/1983 Durenec ..... F25B 9/14 60/520
4,471,625 A * 9/1984 Yasukochi ..... F25B 9/14 60/520
4,543,792 A * 10/1985 Bertsch ..... F02G 1/0445 123/193.6
4,574,591 A * 3/1986 Bertsch ..... F04B 15/08 60/520
4,802,332 A * 2/1989 Beale ..... F02G 1/0435 60/520
4,842,489 A * 6/1989 Lucisano ..... F04B 33/005 417/238
4,922,722 A * 5/1990 Kazumoto ..... F16F 1/08 267/168
4,989,701 A * 2/1991 Yamaoka ..... F16F 9/364 188/315
5,088,289 A * 2/1992 Mita ..... F25B 9/14 60/520
5,449,278 A * 9/1995 Lin ..... F04B 33/005 417/526
5,505,047 A * 4/1996 Hirose ..... F02G 1/043 60/520
5,632,149 A * 5/1997 Tanigawa ..... F02G 1/055 60/520
5,737,924 A * 4/1998 Taguchi ..... F16C 5/00 62/6
5,765,378 A * 6/1998 Stein ..... F25B 9/14 60/520
5,878,570 A * 3/1999 Reithofer ..... F02G 1/0435 60/520
6,286,310 B1 * 9/2001 Conrad ..... F02G 1/0435 60/520
6,616,426 B1 * 9/2003 Liang ..... F04B 39/0005 277/447
6,945,043 B2 * 9/2005 Okano ..... F02G 1/0435 60/517
7,415,829 B2 * 8/2008 Rolff ..... F04B 7/04 417/53
7,600,464 B2 * 10/2009 Cale ..... F02G 1/0435 60/520
7,913,613 B2 * 3/2011 Muth ..... F04B 35/045 92/169.1
9,739,276 B2 * 8/2017 Muth ..... F04B 53/16
9,828,941 B2 * 11/2017 Song ..... F02G 1/044
9,932,975 B2 * 4/2018 Bhakta ..... F04B 39/121
9,976,779 B2 * 5/2018 Xu ..... F25B 9/14
2005/0172646 A1 * 8/2005 Kawabata ..... F04B 39/0005 62/114
2005/0274111 A1 * 12/2005 Yaguchi ..... F01N 5/02 60/520
2006/0048510 A1 * 3/2006 White ..... F02G 1/0435 60/520
2006/0053785 A1 * 3/2006 Mori ..... B60K 8/00 60/520
2006/0090477 A1 * 5/2006 Rolff ..... F04B 7/04 62/6
2006/0179834 A1 * 8/2006 Qiu ..... F02G 1/043 60/520
2007/0033935 A1 * 2/2007 Carroll ..... F02G 1/055 60/520
2007/0151239 A1 * 7/2007 Sakamoto ..... F02G 1/0435 60/520
2007/0169477 A1 * 7/2007 Mori ..... F02B 61/00 60/520
2008/0008610 A1 * 1/2008 Muth ..... F04B 35/045 417/416
2008/0022850 A1 * 1/2008 Kim ..... F04B 39/0005 92/84
2009/0301293 A1 * 12/2009 Bechtold ..... F04B 35/045 92/127
2010/0183450 A1 * 7/2010 Schmidt ..... F04B 35/045 417/212
2011/0011079 A1 * 1/2011 Kamen ..... F02G 1/043 60/520
2013/0287611 A1 * 10/2013 Schmidt ..... F04B 25/02 417/443
2014/0318365 A1 * 10/2014 Muhle ..... F04B 39/126 92/153
2014/0374054 A1 * 12/2014 Xu ..... F28D 17/02 165/10
2015/0101324 A1 * 4/2015 Song ..... F02G 1/044 60/525
2015/0135944 A1 * 5/2015 Muth ..... F04B 39/0005 92/80
2015/0211440 A1 * 7/2015 Joffroy ..... F04B 25/00 60/526
2015/0315997 A1 * 11/2015 Song ..... F02G 1/044 60/526
2016/0123631 A1 * 5/2016 Xu ..... F25B 9/14 62/6
2016/0153446 A1 * 6/2016 Giacchi ..... F04B 39/125 92/169.1
2016/0208790 A1 * 7/2016 Bhakta ..... F04B 39/121
2017/0114781 A1 * 4/2017 Medici ..... F04B 33/00
2017/0343249 A1 * 11/2017 Yamada ..... F25B 9/14
2018/0195502 A1 * 7/2018 Ahn ..... F04B 39/02
2018/0358881 A1 * 12/2018 Hull ..... F01B 1/06
2019/0277542 A1 * 9/2019 Xu ..... F25B 9/14
2019/0316574 A1 * 10/2019 Xu ..... F04B 27/005
2020/0064030 A1 * 2/2020 Ning ..... F04B 7/04

FOREIGN PATENT DOCUMENTS

CN 101415930 A 4/2009
CN 102168720 A 8/2011
CN 103261816 A 8/2013
CN 203702368 U 7/2014
CN 104048436 A 9/2014
CN 107101409 A 8/2017
GB 2469116 A 10/2010
JP 2006292135 A 10/2006
KR 20000007496 A 2/2000
KR 100490208 B1 8/2005

* cited by examiner

DOUBLE ACTING ALPHA STIRLING REFRIGERATOR

CROSS REFERENCE TO THE RELATED APPLICATIONS

This application is the national phase entry of International Application No. PCT/CN2018/083455, filed on Apr. 18, 2018, which is based upon and claims priority to Chinese Patent Application No. 201710347418.3, filed on May 17, 2017, the entire contents of which are incorporated herein by reference.

TECHNICAL FIELD

The present invention relates to refrigerator technology, and in particularly to a double acting alpha Stirling refrigerator.

BACKGROUND

For a long time, refrigeration has always been achieved by using a refrigerant through a compressor. Stirling refrigerators, which have a wide range of refrigeration temperature and a highest theoretical efficiency, are merely used in some deep cryogenic refrigeration. Specifically, the free piston Stirling refrigerator has high stability, but the actual efficiency is low and the cost is relatively high, thus its popularization is difficult. The alpha Stirling refrigerator has a simple structure and a relatively high efficiency, but has a relatively short service life because the piston thereof is sealed by an oil-free dynamic seal and the working medium gets easily leaked and cause pollution.

SUMMARY

Technical Problem

In view of the above technical problems, the present invention provides a double acting Stirling refrigerator, solving the defects of easy leakage of the working medium and the pollution caused, and the issue of relatively short service life of the traditional alpha Stirling refrigerator. Moreover, single action is turned to be double action, improving mechanical efficiency.

Technical Solution

The technical solution of the present invention is:

A double acting alpha Stirling refrigerator includes a piston cylinder and a piston, the piston is provided in the piston cylinder, upper and lower ends of the piston cylinder are closed, and a cylinder air vent is provided at each closed position of the upper and lower ends of the piston cylinder. The piston is in a clearance fit with an inner wall of the piston cylinder, a closed cavity is formed inside the piston.

A pressure relief pipe is provided in the cavity of the piston, and through holes corresponding to outlets of the pressure relief pipe are provided on upper and lower surfaces of the piston, and middle parts of side walls of the piston, respectively.

The outlets of the pressure relief pipe are respectively provided in the through holes and matched with each other in size, so that an interior of the pressure relief pipe is connected to an inner cavity of the piston cylinder outside the piston.

An air outlet for connecting the cavity of the piston to the inner cavity of the piston cylinder is further provided on the side wall of the piston. A gap-sealed and gas-lubricated piston is used to replace an original structure with the piston and a piston ring.

A traction frame capable of moving relative to the piston cylinder is provided outside the piston cylinder, and a movement of the piston is controlled by a movement of the traction frame.

One-way air outlet valves and one-way air intake valves are further provided.

Specifically, the one-way air outlet valves are provided on an upper part and a lower part of the pressure relief pipes corresponding to the upper and lower surfaces of the piston, so that the air flow can only flow along a middle part of the pressure relief pipe toward upper and lower end faces of the piston and flow into the inner cavity of the piston cylinder.

The one-way air intake valves are provided on side walls of the pressure relief pipes outside the one-way air outlet valves or on the upper and lower end faces of the piston, so that the inner cavity of the piston cylinder is connected to the interior of the cavity of the piston. The one-way air intake valves allow gas to enter the cavity of the piston only from the inner cavity of the piston cylinder.

A guiding groove is provided on an outer side wall of the piston, and the guiding groove surrounds the piston, and the outlets of the pressure relief pipe on the side wall of the piston are intercommunicated. The guiding groove facilitates the collection of the gas flowing out of the air outlets and allows the gas to flow into the pressure relief pipe.

A piston magnet is provided at a bottom of the piston, a traction magnet is provided on the traction frame, the traction magnet is provided corresponding to the piston magnet, and the two magnets move simultaneously by a magnetic force. Except for the magnets, other components are not magnetically conductive.

The piston magnet is a disk-shaped strong magnet with a hole in the middle, the traction magnet is a ring-shaped strong magnet; the two magnets have a same thickness.

Different magnetic poles of the two magnets are configured oppositely on a same height, so that the piston magnet is stabilized at a center of the traction magnet. Permalloy sheets or silicon steel sheets having a same shape may be added to two poles of the magnet to collect magnetism to obtain a larger force. Magnetism gathering is performed on both ends of the strong magnet with a ferromagnetic material to enhance the force between the magnets, thereby reducing the number of magnets required.

A crank-connecting rod mechanism is further included. The above-mentioned traction frame is hinged to one end of a connecting rod of the crank-connecting rod mechanism.

Each two groups of piston cylinders and pistons form a set. The air vents at the upper parts of two piston cylinders are connected to each other, the air vents at the lower parts of the two piston cylinders are connected to each other, and a regenerator and a heat exchanger are provided on a pipeline at a connecting position. Traction frames of the two piston cylinders are respectively connected to the same crank-connecting rod mechanism.

A maximum pressure intensity difference between the two systems is reduced by appropriately increasing a phase difference, and a volume ratio of a cold cylinder to a hot cylinder is configured to be equal to a ratio of a preset low temperature to a preset high temperature.

Operating principle: gas applies work externally through expansion to lower the temperature, and gas is compressed to apply work to increase the temperature. The system expands the gas at low temperatures, and absorbs heat from the environment to be cooled; compresses the gas at high temperatures, and releases heat to the outside environment.

The beneficial effects of the invention are:

In the present invention, the traditional single acting alpha Stirling refrigerator is turned into a double acting alpha Stirling refrigerator, which improves the mechanical efficiency and makes the working medium remain in a completely internal circulation without causing leakage and pollution. Using the ferromagnetic material to carry out magnetism gathering at both ends of the strong magnet can enhance the force between the magnets, thereby reducing the number of magnets required. Compared with the gas bearing in the free piston Stirling refrigerator, the piston uses a new self-lubricating gas bearing support technology, which can make the air outlets at both ends work at states 1-4 in the embodiments, and the gas film stiffness is stable, so that no friction occurs in the non-stop operation, and the overall structure of machine is simple, stable, efficient and has long service life.

Where, 1—piston cylinder, 2—piston, 3—one-way air outlet valve, 4—side wall air outlet, 5—pressure relief pipe, 6—piston magnet, 7—traction magnet, 8—traction frame, 9—cylinder air vent, 10—one-way air intake valve, 11—guiding groove, 12—heat exchanger, 13—regenerator, and 14—crank-connecting rod mechanism.

DETAILED DESCRIPTION OF THE EMBODIMENTS

Figure 1:
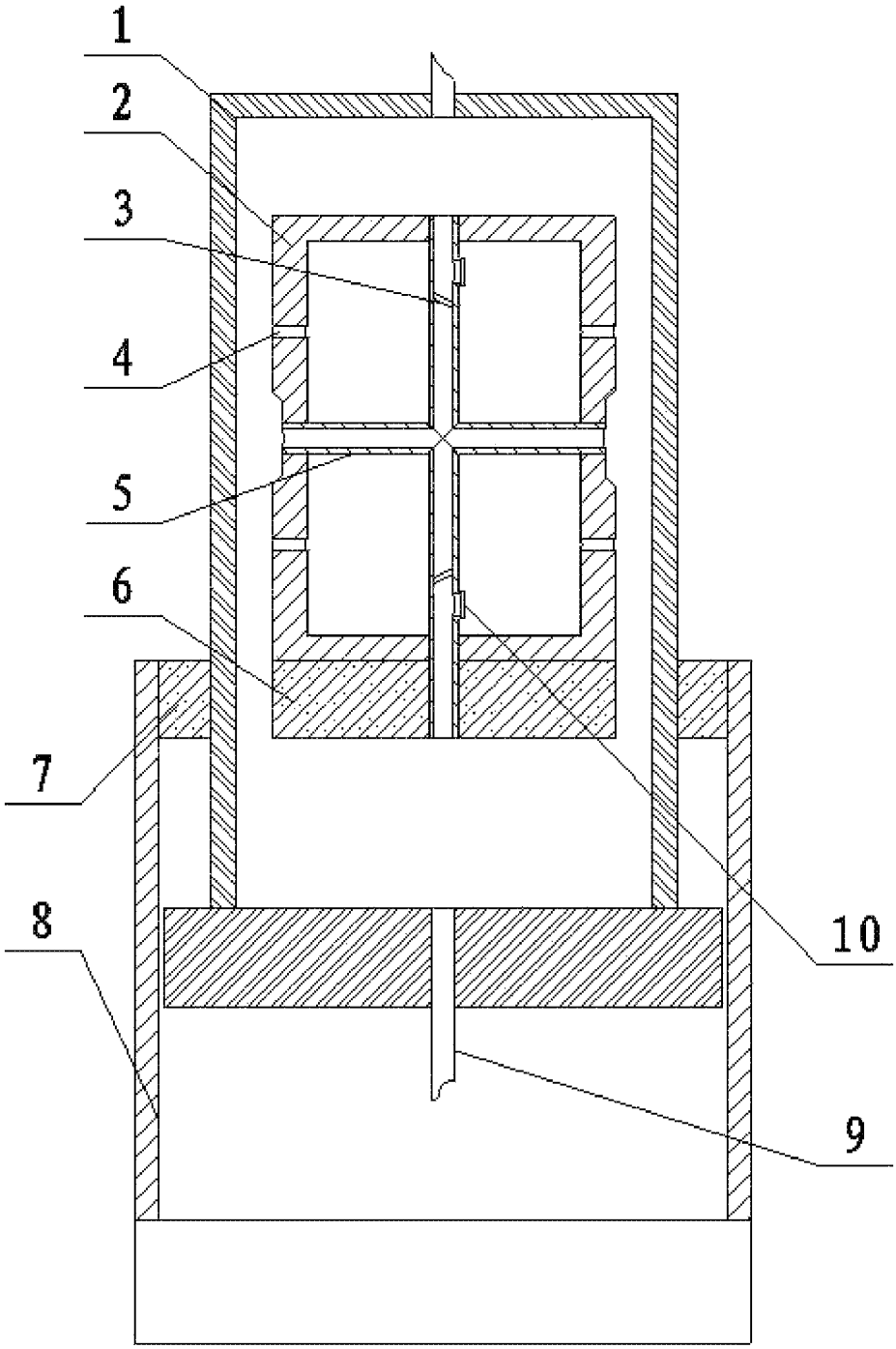
FIG. 1 is a cross-sectional view showing a structure of the present invention.
Figure 2:
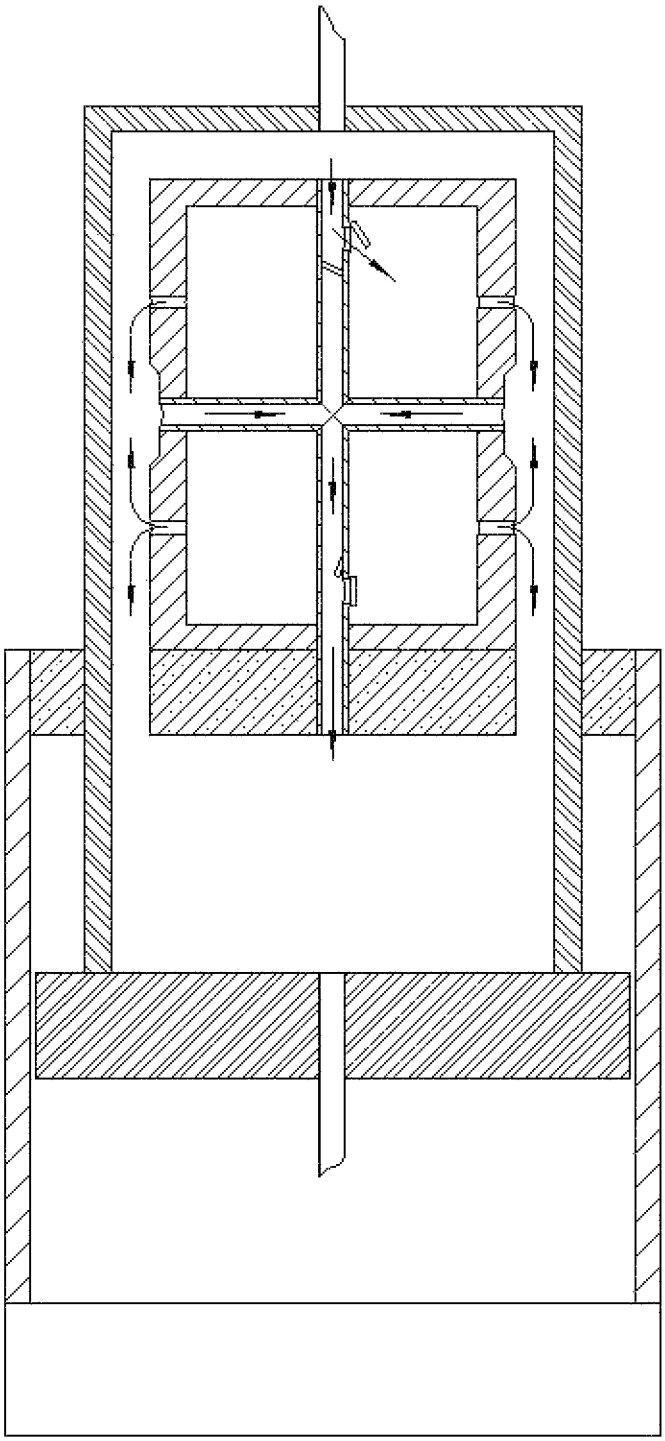
FIG. 2 is a schematic view showing a flow of airflow when a pressure intensity above a piston is high.

The contents of the present invention are described in detail below:

The gas flow direction of the gas storage chamber of the piston in each state is as follows:

As shown in FIGS. 1-2, when the pressure intensity above a piston 2 is higher than the pressure intensity of the cavity of the piston, the gas enters the cavity of the piston from a one-way air intake valve 10 located at an upper part of the piston, and a one-way outlet valve 3 at the upper part is closed. The pressure intensity in the cavity of the piston is relatively high, and the gas coming out from a side wall air outlet 4 in the upper part of the piston 2 can only move downward due to the high pressure intensity of the upper part, and then flows into a pressure relief pipe 5 located at a middle part. At this time, a one-way outlet valve 3 at a lower part is opened, a one-way air intake valve 10 is closed, and the gas flows to a low pressure chamber at the lower part. The gas from the side wall air outlet 4 in the lower portion of the piston 2 flows up and down, on one hand, flows through the pressure relief pipe 5 into the low pressure chamber at the lower part, and on the other hand, flows directly from a gap between the piston 2 and the piston cylinder 1 into the low pressure chamber at the lower part.

Figure 3:
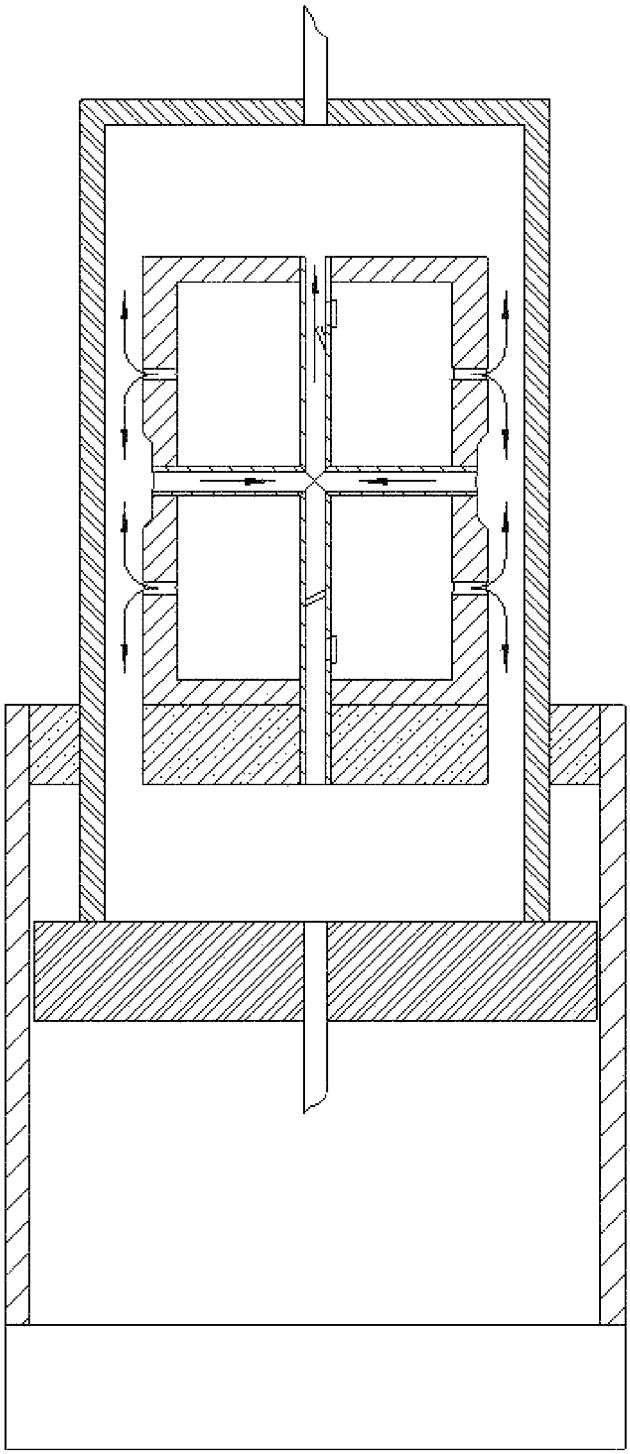
FIG. 3 is a schematic view showing a flow of airflow when pressure intensities of upper and lower end faces of a piston are both lower than an internal pressure intensity of the piston.

When the pressure intensities of the upper and lower end faces of the piston 2 are both lower than a pressure intensity inside the piston, the one-way air intake valves 10 are completely closed. Only the one-way air outlet valve 3 at one end of the piston 2 having a lower pressure intensity is opened, and the one-way air outlet valve 3 at the other end is closed. At this time, the gas flows into the inner cavity of the piston cylinder 1 through the gap between the piston 2 and the piston cylinder 1, and the pressure relief pipe 5. As shown in FIG. 3, the pressure intensity at the upper end of the piston 2 is lower at this time.

Figure 4:
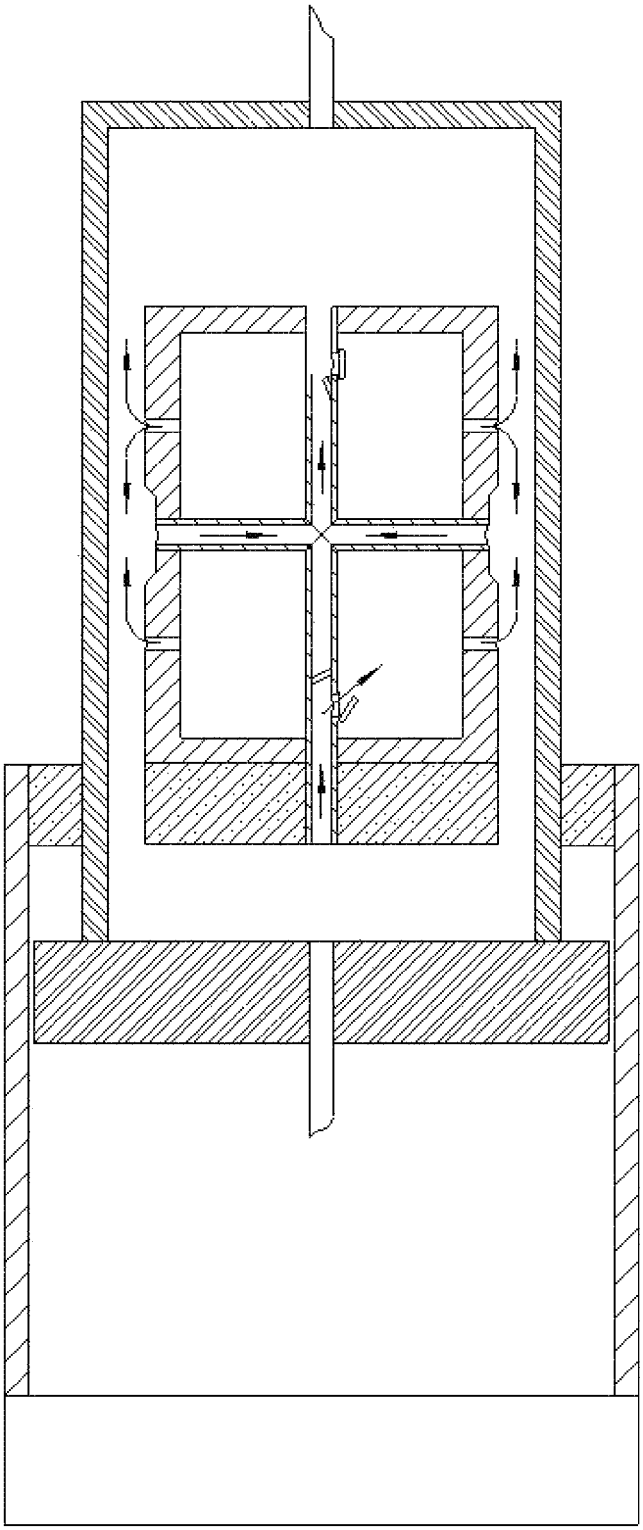
FIG. 4 is a schematic view showing a flow of airflow when a pressure intensity below a piston is high.

As shown in FIG. 4, when the pressure intensity of a lower part of the piston 2 is higher than the pressure intensity of the cavity of the piston, the gas enters the cavity of the piston from the one-way air intake valve 10 at the lower part. At this time, the one-way air outlet valve 3 at the lower part is closed, and the pressure intensity in the cavity of the piston is relatively high. The gas coming out from the side wall air outlet 4 of the piston 2 can only flow upward due to the high pressure intensity at the lower portion, and then flow to the low pressure chamber at the upper part through the pressure relief pipe 5 at the middle. The gas from the side wall air outlet 4 of the piston 2 at the upper part flows up and down, on one hand, flows through the pressure relief pipe 5 into the low pressure chamber at the upper part, and on the other hand, directly flows from the gap between the piston 2 and the piston cylinder 1 into the low pressure chamber at the upper part.

In summary: when the equipment is in operation, the pressure will be changing all the time, the side wall air outlet 4 of the piston 2 will have gas flowing out at states 1-4, and the piston 2 can operate without friction as long as the gas is still discharged.

Figure 5:
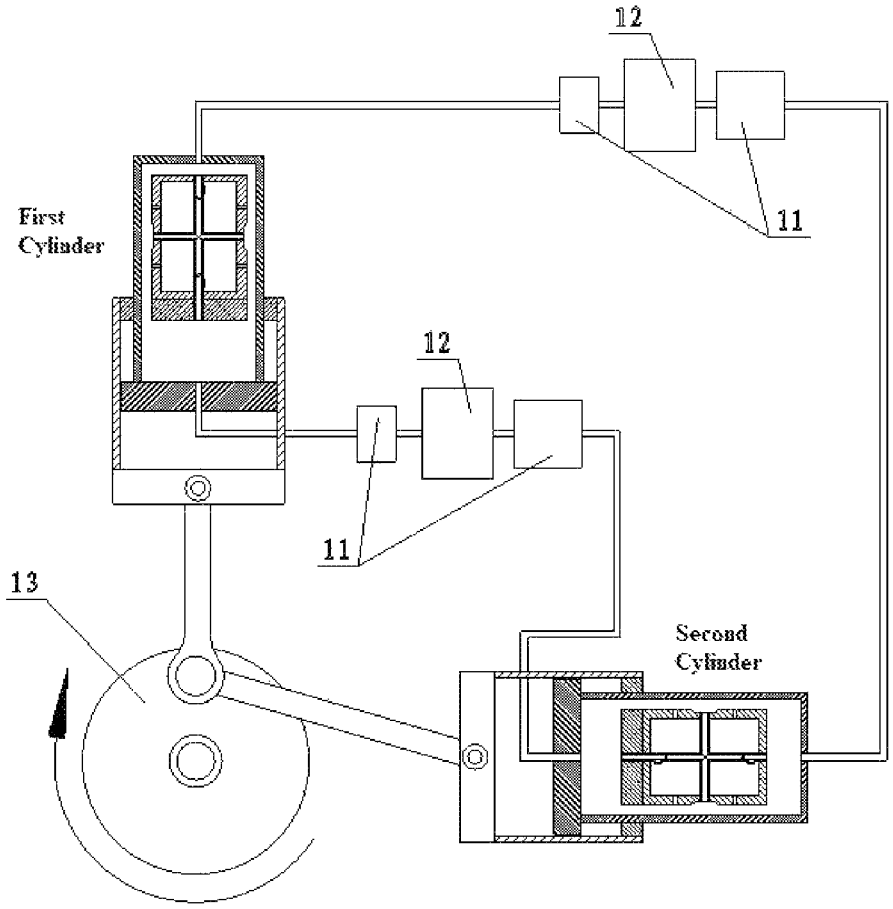
FIG. 5 is a schematic view of an operation of the present invention.
Figure 6:
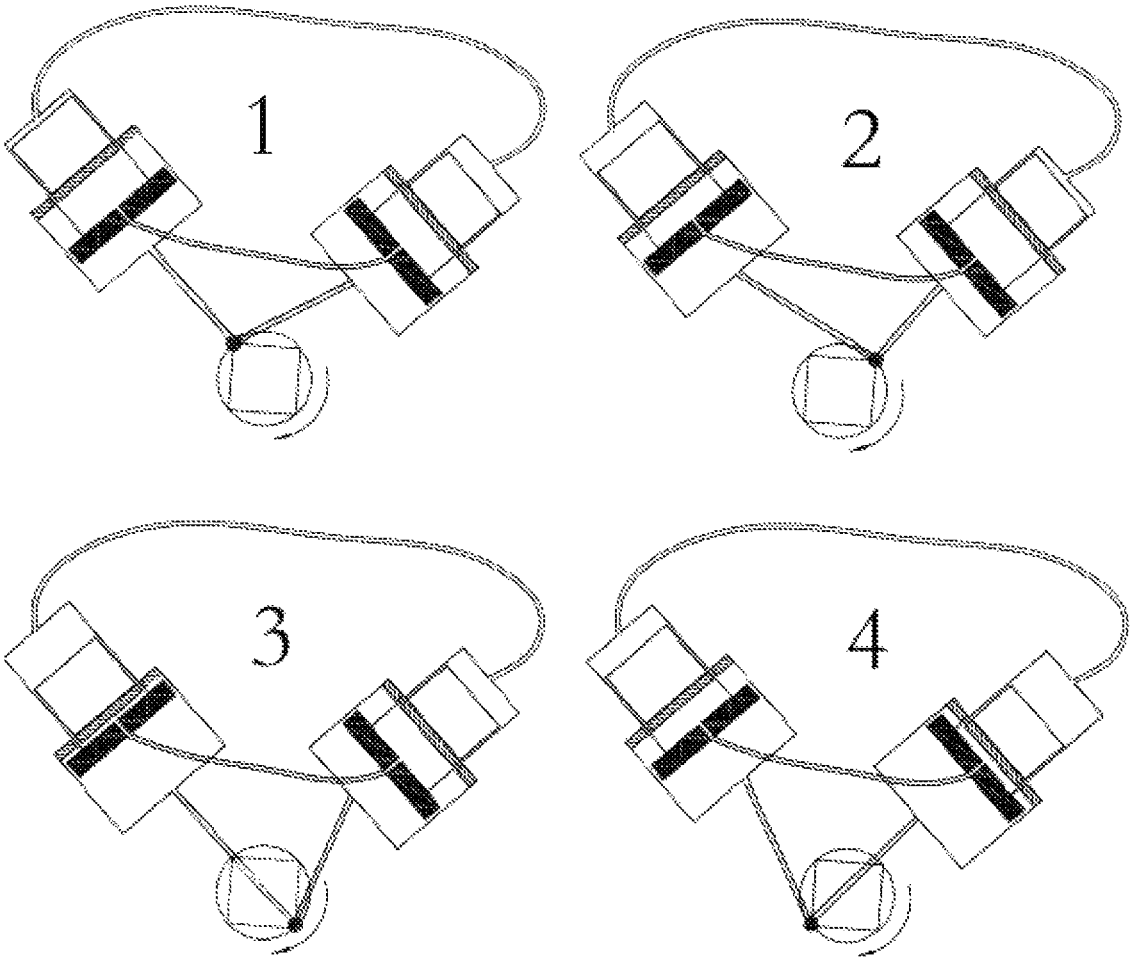
FIG. 6 is a process view of an operation state of a refrigeration system.

As shown in FIGS. 5-6:

Operation Process:

Each two groups of piston cylinders and pistons form a set of refrigeration system. The air vents at the upper parts of two piston cylinders are connected to each other, the air vents at the lower parts of the two piston cylinders are connected to each other, and a regenerator and a heat exchanger are provided on the pipeline at connecting position. Traction frames of the two piston cylinders are respectively connected to the same crank-connecting rod mechanism.

Taking the flywheel clockwise rotation as an example, the upper cavity of the first cylinder and the upper cavity of the second cylinder constitute the system A. The lower cavity of the first cylinder and the lower cavity of the second cylinder constitute the system B. It is defined that the cylinder at the left side is the first cylinder, and the cylinder at the right side is the second cylinder.

The piston of the first cylinder at the uppermost part is set as the initial state, from state 1 to state 2, the flywheel rotates 90 degrees clockwise, which is the gas removal process. When passing through the heat exchanger 12, the gas in the lower cavity of the first cylinder absorbs heat from the system to be cooled; when passing through the regenerator 13, the cold energy is left in the regenerator 13; when passing through the heat exchanger at a high temperature, no heat exchange occurs; and finally the gas enters the lower chamber of the second cylinder. The gas in the upper chamber of the second cylinder passes through the heat exchanger 12, dissipating the heat in the environment. The gas is cooled to the temperature of the system when passing through the regenerator 13, and no heat exchange occurs when the gas passes through the heat exchanger 12 at a low temperature.

From state 2 to state 3, the flywheel rotates from 90 degree to 180 degrees. System A is subjected to an expansion and cooling process, mainly occurring in the first cylinder, which causes the gas in the upper chamber of the first cylinder to be cooled down and have a temperature lower than the system temperature. System B is subjected to a compression and heating process, mainly occurring in the second cylinder, which causes the temperature of the gas in the lower chamber of the second cylinder to be increased and higher than the temperature of the environment.

From state 3 to state 4, the flywheel rotates 180 degree to 270 degrees. It is subjected to the air moving process. When passing through the heat exchanger 12, the gas in the upper cavity of the first cylinder absorbs heat from the system to be cooled; when passing through the regenerator 13, the cold energy is left in the regenerator 13; when passing through the heat exchanger at a high temperature, no heat exchange occurs, and finally the gas enters the upper chamber of the second cylinder. The gas in the lower chamber of the second cylinder passes through the heat exchanger 12, dissipating heat in the environment. The gas is cooled to the temperature of the system when passing through the regenerator 13. No heat exchange occurs when the gas passes through the heat exchanger 12 at a low temperature.

From state 4 to state 1, the flywheel rotates from 270 degree to 360 degrees. System A is subjected to a compression and heating process, mainly occurring in the second cylinder, which causes the temperature of the gas in the upper chamber of the second cylinder to be increased and higher than the temperature of the environment. System B is subjected to the expansion and cooling process, mainly occurring in the first cylinder, which causes the gas in the lower chamber of the first cylinder to be cooled down and have a temperature lower than the temperature of the system.

In the whole process, the first cylinder is a cold cylinder, which is mainly subjected to expansion. The second cylinder is a hot cylinder, which is mainly subjected to compression.

Figure 7:
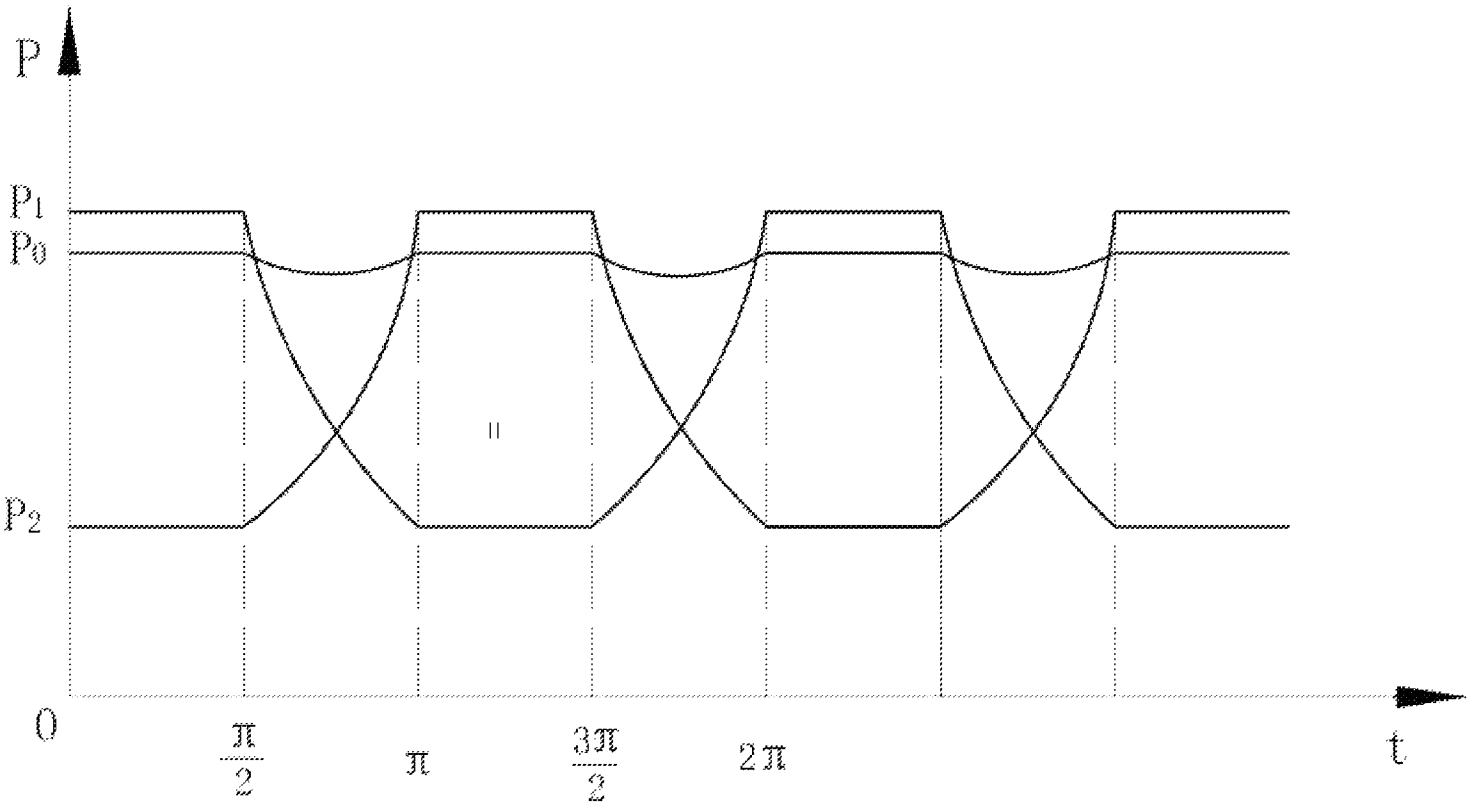
FIG. 7 is a schematic diagram showing a change of an operating pressure intensity of a system.

FIG. 7 is a diagram showing the pressure intensity change of the refrigeration system and the piston cavity based on that the volume ratio of the cold cylinder to the hot cylinder is equal to the ratio of the low temperature T to the high temperature T. The piston of the first cylinder at the uppermost part is set as the initial state, P0 is the pressure intensity change in the cavity of the piston, P1 is the pressure intensity change in the A system, P2 is the pressure intensity change in the B system.

What is claimed is:

1. A double acting alpha Stirling refrigerator, comprising: at least one piston cylinder and at least one piston, wherein, the at least one piston is provided in the at least one piston cylinder, upper and lower ends of the at least one piston cylinder are closed, a cylinder air vent is provided at each closed position of the upper and lower ends of the at least one piston cylinder, the at least one piston is in a clearance fit with an inner wall of the at least one piston cylinder, and a closed cavity is formed inside the at least one piston;

a pressure relief pipe is provided in the closed cavity of the at least one piston, and through holes corresponding to outlets of the pressure relief pipe are provided in upper and lower surfaces of the at least one piston, and middle parts of side walls of the at least one piston, respectively;

the outlets of the pressure relief pipe are respectively provided in the through holes and matched to the through holes in size, so that an interior of the pressure relief pipe is connected to an inner cavity of the at least one piston cylinder outside the at least one piston;

air outlets for connecting the closed cavity of the at least one piston to the inner cavity of the at least one piston cylinder are provided on the side walls of the at least one piston; and a traction frame configured to move relative to the at least one piston cylinder is provided outside the at least one piston cylinder, and a movement of the at least one piston is controlled by a movement of the traction frame, wherein a first one-way air outlet valve is provided on an upper part of the pressure relief pipe corresponding to the upper surface of the at least one piston, a second one-way air outlet valve is provided on a lower part of the pressure relief pipe corresponding to the lower surface of the at least one piston, so that the air only flows along a middle part of the pressure relief pipe toward upper and lower end faces of the at least one piston and flows into the inner cavity of the at least one piston cylinder;

a first one-way air intake valve is provided on a side wall of the pressure relief pipe outside the first one-way air outlet valve or on the upper end face of the at least one piston, a second one-way air intake valve is provided on a side wall of the pressure relief pipe outside the second one-way air outlet valve or on the lower end face of the at least one piston so that the inner cavity of the at least one piston cylinder is connected to the interior of the closed cavity of the at least one piston; the one-way air intake valves allow gas to enter the closed cavity of the at least one piston only from the inner cavity of the at least one piston cylinder.

2. The double acting alpha Stirling refrigerator of claim 1, further comprising a crank-connecting rod mechanism, wherein the traction frame is hinged to one end of a connecting rod of the crank-connecting rod mechanism.

3. The double acting alpha Stirling refrigerator of claim 2, wherein, the at least one piston cylinder are two piston cylinders, the at least one piston are two pistons, and two groups comprising the two piston cylinders and the two pistons form a set of the double acting alpha Stirling refrigerator, wherein each of the two groups comprises one of the two piston cylinders and one of the two pistons; the air vents at the upper parts of the two piston cylinders are connected to each other, the air vents at the lower parts of the two piston cylinders are connected to each other, and a heat exchanger is provided on each of two pipelines; traction frames of the two piston cylinders are respectively connected to the crank-connecting rod mechanism, wherein a regenerator is provided on the crank-connecting rod mechanism.

4. The double acting alpha Stirling refrigerator of claim 1, wherein, a guiding groove is provided on an outer side wall of the at least one piston and surrounds the at least one piston, and the guiding groove connects with the outlets of the pressure relief pipe on the side walls of the at least one piston.

5. The double acting alpha Stirling refrigerator of claim 4, further comprising a crank-connecting rod mechanism, wherein the traction frame is hinged to one end of a connecting rod of the crank-connecting rod mechanism.

6. The double acting alpha Stirling refrigerator of claim 4, wherein, a piston magnet is provided at a bottom of the at least one piston, a traction magnet is provided on the traction frame, and the traction magnet is provided corresponding to the piston magnet; the piston magnet and the traction magnet move simultaneously by a magnetic force.

7. The double acting alpha Stirling refrigerator of claim 6, further comprising a crank-connecting rod mechanism, wherein the traction frame is hinged to one end of a connecting rod of the crank-connecting rod mechanism.

8. The double acting alpha Stirling refrigerator of claim 6, wherein, the piston magnet is a disk-shaped strong magnet with a hole in the middle, the traction magnet is a ring-shaped strong magnet; the piston magnet and the traction magnet have a same thickness.

9. The double acting alpha Stirling refrigerator of claim 8, further comprising a crank-connecting rod mechanism, wherein the traction frame is hinged to one end of a connecting rod of the crank-connecting rod mechanism.

10. The double acting alpha Stirling refrigerator of claim 8, wherein, different magnetic poles of the piston magnet and the traction magnet are configured oppositely on a same height, so that the piston magnet is stabilized at a center of the traction magnet.

11. The double acting alpha Stirling refrigerator of claim 10, further comprising a crank-connecting rod mechanism, wherein the traction frame is hinged to one end of a connecting rod of the crank-connecting rod mechanism.

12. The double acting alpha Stirling refrigerator of claim 10, wherein, the piston magnet and the traction magnet are provided with a ferromagnetic material to enhance the force between the piston magnet and the traction magnet.

13. The double acting alpha Stirling refrigerator of claim 12, further comprising a crank-connecting rod mechanism, wherein the traction frame is hinged to one end of a connecting rod of the crank-connecting rod mechanism.

* * * * *